US007889036B2

(12) United States Patent
Fiedler

(10) Patent No.: US 7,889,036 B2
(45) Date of Patent: Feb. 15, 2011

(54) MAGNETIC HOLDING DEVICE

(76) Inventor: Joachim Fiedler, Seelhorststrasse 38, 30175 Hannover (DE)

( * ) Notice: Subject to any disclaimer, the term of this patent is extended or adjusted under 35 U.S.C. 154(b) by 52 days.

(21) Appl. No.: 11/908,214

(22) PCT Filed: Mar. 9, 2006

(86) PCT No.: PCT/DE2006/000418

§ 371 (c)(1),
(2), (4) Date: Jul. 8, 2008

(87) PCT Pub. No.: WO2006/094491

PCT Pub. Date: Sep. 14, 2006

(65) Prior Publication Data

US 2009/0021333 A1 Jan. 22, 2009

(30) Foreign Application Priority Data

Mar. 9, 2005 (DE) ..... 10 2005 011 158

(51) Int. Cl.
*H01F 7/02* (2006.01)
*E05C 17/56* (2006.01)
*E05C 19/16* (2006.01)

(52) U.S. Cl. ..... 335/306; 335/302; 292/251.5

(58) Field of Classification Search ..... 335/302, 335/306; 292/251.1
See application file for complete search history.

(56) References Cited

U.S. PATENT DOCUMENTS 2,648,884 A * 8/1953 Loofboro ..... 24/303
3,009,725 A 11/1961 Koch
3,288,511 A * 11/1966 Tavano ..... 292/251.5
3,372,443 A * 3/1968 Daddona, Jr. ..... 24/303
3,596,958 A * 8/1971 Bowerman ..... 292/201
3,992,689 A 11/1976 Kaplow
4,099,755 A * 7/1978 Anderson ..... 292/251.5
4,222,021 A * 9/1980 Bunker, Jr. ..... 335/296
4,265,002 A * 5/1981 Hosken ..... 24/303

(Continued)

FOREIGN PATENT DOCUMENTS

BE 669664 12/1965

(Continued)

*Primary Examiner*—Anh T Mai
*Assistant Examiner*—Alexander Talpalatskiy
(74) *Attorney, Agent, or Firm*—Henry M. Feiereisen; Ursula B. Day

(57) ABSTRACT

The invention relates to a universally-applicable, detachable magnetic catch, suitable, for example, for the closing and opening of containers of for fixing or releasing an object, whereby each magnet (3*a*, 3*b*, 4*a*, 4*b*, 16, 19, 21) is held with a positive fit in the recess (15, 18, 21) of a holder (11, 12, 14, 17, 20). One of said holders may be displaced by means of an operating device (5, 13) such that the magnetic poles of the magnets oppose each other to be either attracting or repelling. Each magnet has an upper side, an underside, parallel to the above and a circumferential surface at an angle of 90 DEG to the upper and underside. The upperside and the underside of the magnet are a non-symmetrical planar surface and the recess of the holder has a horizontal cross-sectional surface, identical to the non-symmetrical form of the upperside and the underside such that the magnet may only be introduced into the corresponding recess with the poles in a functional alignment.

5 Claims, 3 Drawing Sheets

U.S. PATENT DOCUMENTS

| | | | | |
|---|---|---|---|---|
| 5,367,891 | A * | 11/1994 | Furuyama | 63/29.2 |
| 6,594,871 | B2 * | 7/2003 | Hoffman | 24/303 |
| 6,640,398 | B2 * | 11/2003 | Hoffman | 24/303 |
| 6,707,360 | B2 * | 3/2004 | Underwood et al. | 335/288 |
| 6,747,537 | B1 * | 6/2004 | Mosteller | 335/306 |
| 6,929,291 | B2 * | 8/2005 | Chen | 292/251.5 |
| 2005/0023841 | A1 | 2/2005 | Chen | |

FOREIGN PATENT DOCUMENTS

| | | |
|---|---|---|
| DE | 97 706 | 5/1973 |
| DE | 24 55 520 | 5/1976 |
| DE | 23 23 058 | 11/1976 |
| DE | 89 02 181 | 6/1989 |
| DE | 296 22 577 | 6/1997 |
| DE | 102004015718 | 5/2005 |
| WO | WO2005/094625 | 10/2005 |
| WO | WO2005/096264 | 10/2005 |

* cited by examiner

MAGNETIC HOLDING DEVICE

The invention relates to an universally applicable, detachable magnetic holding device, suited, for example, for closing and opening of containers or for fixing or releasing of an object.

Detachable magnetic holding devices using the magnetic holding force of permanent magnets have already been known from prior art. When the magnets are arranged so that, in the closed state of the device, magnet poles having different polarities are opposite to each other, and in the opened state, magnet poles having the same polarities are opposite to each other, it is possible to gain a self-acting opening and releasing procedure, respectively, in addition to keep the device closed. For example, this prior art is described in the documents DD 97706, BE 669664, DE 2323058, DE 29622577 or DE 8902181.

Many of such applications use two or more uniform magnets. For example, when 4 magnets are arranged on each side of a magnetic holding device and one of the magnets is set incorrectly, there is the possibility that the holding capability of the device will be impaired. Therefore, the individual assembling the device must pay attention to install the magnets correctly. Conventionally, the pole surfaces of magnets are colored to prevent the magnets from being installed incorrectly. However, marking magnets incorrectly can not be excluded.

Therefore, there is the demand to provide a magnetic holding device as mentioned above, which will always be assembled correctly by an individual, that is, will function according to the constructional point.

This object is gained by a magnetic holding device according to claim 1.

This holding device serves to keep together and release two elements relatively movable to each other. At least one magnet is installed in each of the elements, wherein each magnet is held in a recess of a holder in a form-locking way. One of the holders is movable by means of a control mechanism so that the poles of the magnets are positioned opposite to and attract or repel each other. Moving of the holder is done by rotation or shifting. When the magnet poles attract each other, the elements are held together by the magnetic force.

When the magnet poles repel each other, the elements are kept away from each other by a certain distance by means of the magnetic force. Each of the magnets has a top surface, an bottom surface in parallel with the top surface and a circumferential surface extending at an angle of 90° to them. The top surface and the bottom surface of the magnet have the same size and the same shape. According to the invention, the top surface and the bottom surface of the magnet are plane but asymmetrically formed, wherein asymmetry means the property of the surfaces not to be in coincidence when turned by 180 degrees. The recess of the holder comprises a horizontal surface identical to the asymmetric shape of the top surface and the bottom surface of the magnet so that the magnet can be inserted into the respective recess only when its poles are correctly oriented. Based on the described technical science, a great number of asymmetric shapes are available so that an expert will be able to chose a shape suited for to the technical demand, without having to be inventive himself.

Thus, the object to provide a magnetic holding device which is reliable in function and can be assembled cost-effectively is accomplished.

According to claim 2, the recess in the holder is formed so that the magnet is inserted into it from above and is settable by its front side to a stop, for example, down to the bottom of the recess and can be fixed by a usual fixing technology such as pressing. This enables the magnets to be arranged simply and reliably at functionally predetermined positions so that the poles of the magnets have a predetermined distance to each other when they generate an attracting force.

According to claim 3, the recess in the holder is formed so that the magnet is pressable with its back side to a stop, that is, the magnet is inserted into the recess from behind and can be fixed by a suited fixing technology such as pressing. For example, the stop can be a circular shoulder. Also, this measure enables the magnets to be arranged simply and reliably at functionally predetermined positions.

Now, the invention will be explained more clearly in connection with the accompanying drawings.

FIGS. 1*a, b* show an embodiment of the invention, which is used in a bow holder for holding a stringed instrument bow.

Figure 1A:
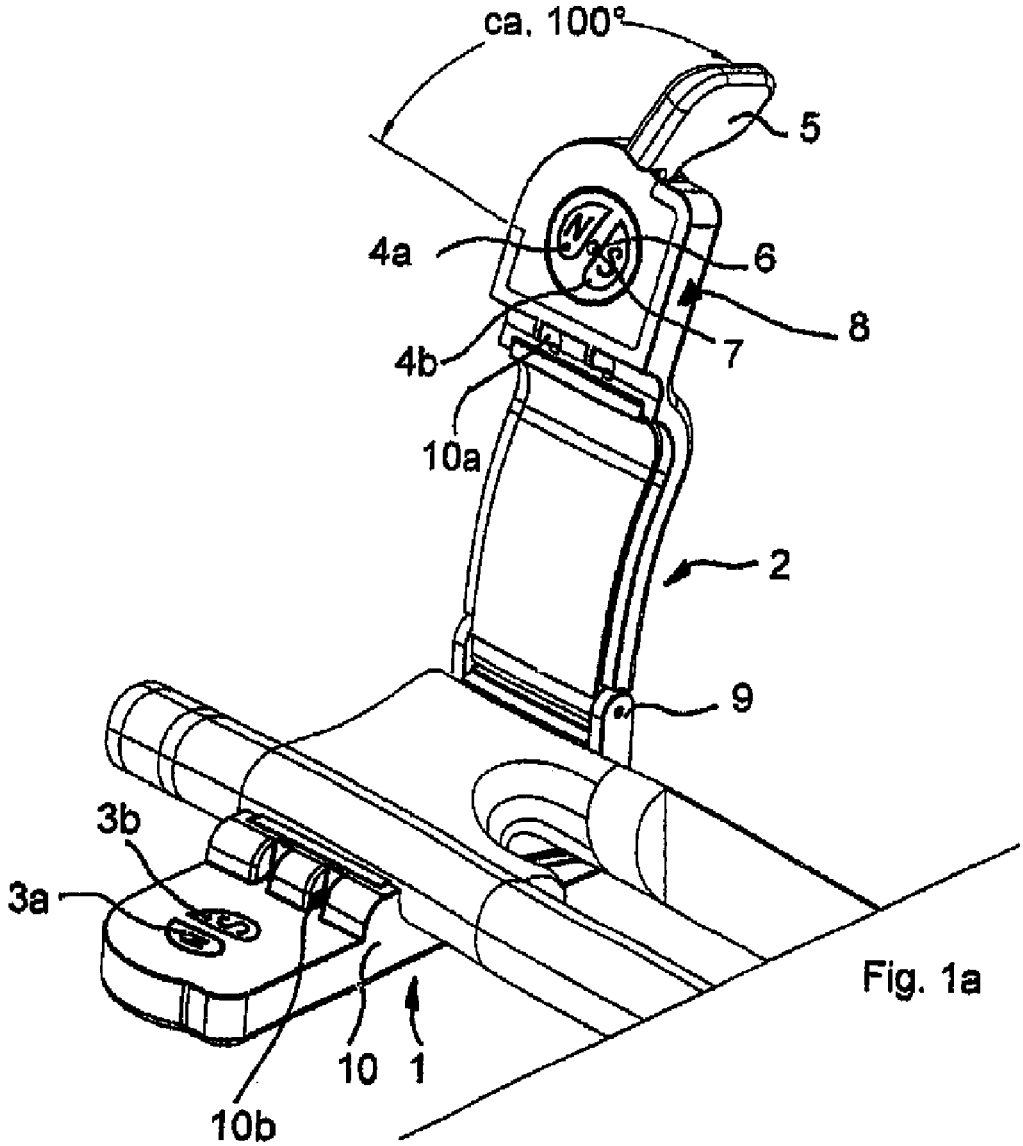
Figure 1B:
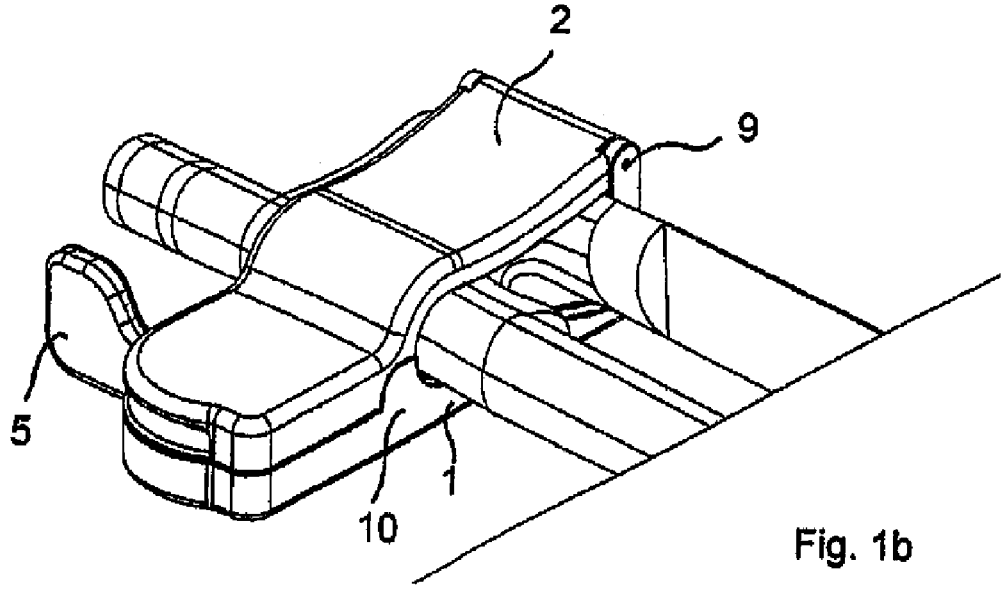

FIGS. 1*a* and 1*b* show a bow holder for holding a stringed instrument bow, in the opened and the closed state, respectively. A pair of magnets 3*a*,3*b* and 4*a*,4*b* each are arranged at the bottom part 1 and the pivotable top part 2, respectively, wherein the pair of magnets 3*a*,3*b* is fixedly arranged and the pair of magnets 4*a*,4*b* is pivotable by about 100 degrees around a fulcrum point 6 by means of a lever 5. Reference mark 7 denotes a distance element. This distance element is fixed at the fulcrum point 6 and serves to prevent the magnets from contacting each other, when the bow holder is closed, that is, when the magnet poles having different polarities are opposite to and attract each other. An expert certainly knows in which way a rotatable magnet can in principle be held in a case 8 so that any further explanation will be omitted. The magnets are dimensioned so that, when the bow holder is being closed, the rotatable pair of magnets is rotated automatically, that is, by magnetic forces only into the closed state, where the magnet poles having different polarities are opposite to each other. When the pair of magnets 4*a*,4*b* is rotated by means of the lever 5, the holding force is gradually reduced, passes a neutral state, where the attracting forces and the repelling forces are in balance, and changes into a repelling force which becomes stronger and stronger and finally opens the bow holder.

During closing and opening of the bow holder, shear forces are also generated, which cause the opposite-laying magnets to be displaced to each other laterally. These shear forces can clearly be observed when trying to manually lay two magnets having the same polarity on each other. The shear forces apply a torque to the joint 9 via the top part and the bottom part of the bow holder, which increases with the length of both these parts, that is with the length of the lever arms thereof. This torque must be received by the joint structure. In order to prevent this, the invention comprises a centering engaging device 10. With this exemplified embodiment, the centering engaging device 10 comprises projections 10*a* which, in a predetermined phase before the bow holder is completely closed, slide into recesses 10*b* and thereby, receive the shear forces approximately there where they are generated.

The structure and the magnet power are dimensioned so that, when the magnetic holding device is opened, the centering engaging device 10 remains engaged until the shear forces have been reduced to a predetermined value.

It is recognizable that the magnets have an asymmetrical cross-sectional shape. This enables the magnets to be inserted into the respective recesses, with their poles being oriented correctly.

Figure 2:
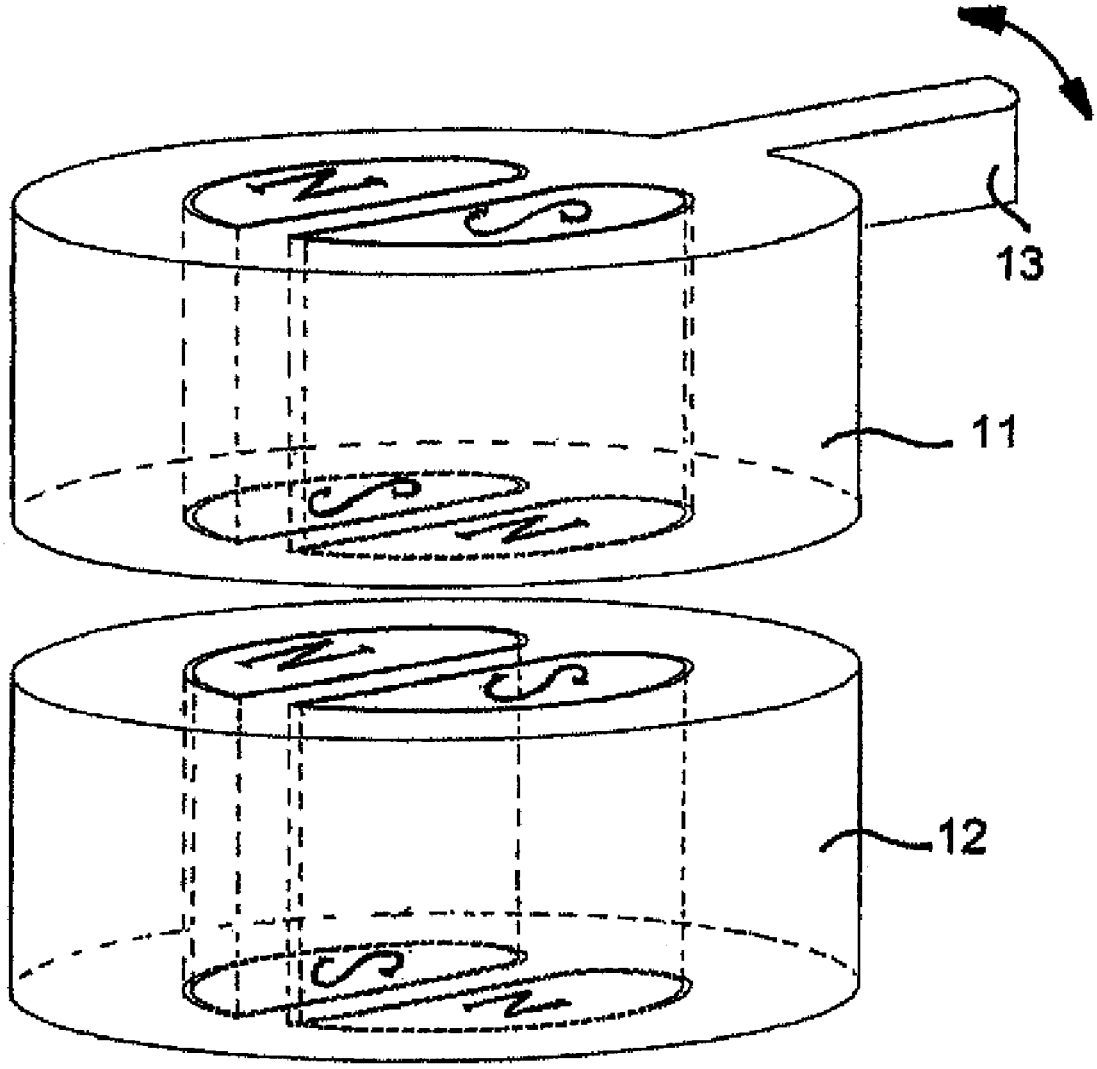
FIG. 2 shows schematically the fundamental idea of the invention.

FIG. 2 shows the fundamental idea of the invention by means of two magnet modules 11 and 12 arranged opposite to each other, wherein the module 11 is pivotable by a lever 13 in the direction marked by an arrow and the magnet poles attract and repel each other, respectively at the corresponding one of the two final positions of the lever. The asymmetrical shape of the magnets can clearly be seen from the drawing.

Figure 3:
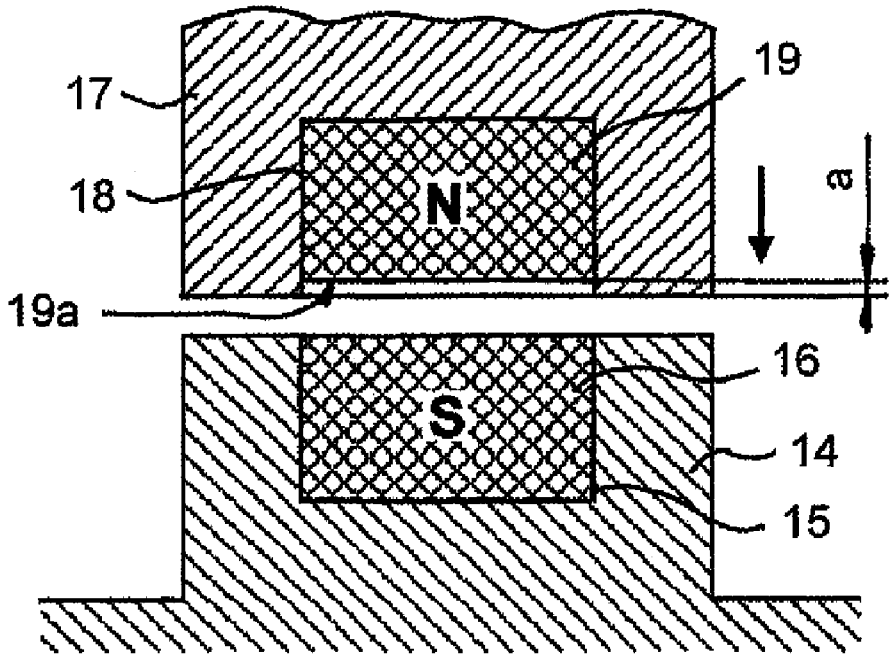
FIG. 3 shows a cross-sectional view of a first engineering design according to the invention.

FIG. 3 shows a detail of the magnetic holding device according claim 2. A fixedly arranged case 14 comprises a recess 15 having a predetermined depth. This depth corresponds to the height of the magnet 16 so that the top surface of the magnet is flush with top surface of the case.

The case 17 arranged above the case 16 comprises a recess 18, which is somewhat deeper than the height of the magnet 19 so that the top surface 19*a* of the magnet 19 is reset by a distance a. Therefore, the top surfaces of both magnets are distanced by a predetermined small amount when the poles are opposite to and attract each other. This enables a better opening and closing behavior to be gained.

Figure 4:
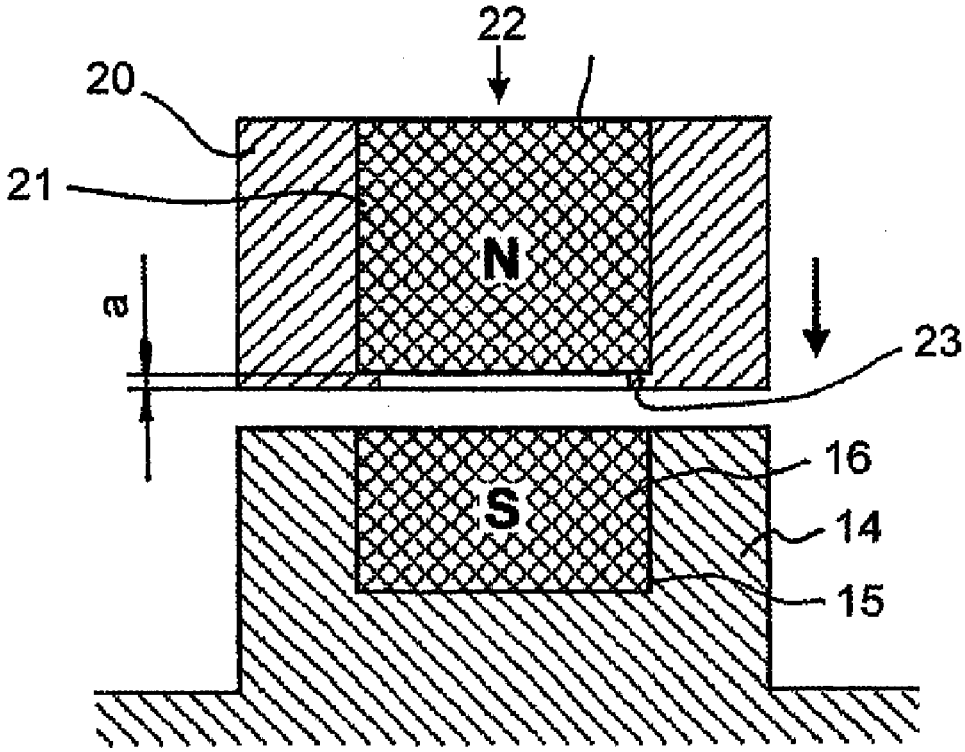
FIG. 4 shows a cross-sectional view of a second engineering design according to the invention.

FIG. 4 shows a detail of the magnetic holding device according to claim 3. A fixedly arranged case 14 comprises a recess 15 having a predetermined depth. This depth corresponds to the height of the magnet 16 so that the top surface of the magnet is flush with top surface of the case.

The case 20 arranged above the case 16 comprises a recess 21 into which the magnet 22 is inserted from above. The lower section of the recess 21 is provided with a shoulder 23 having a predetermined thickness. Therefore, the magnet 22 can only be pressed into the recess down to the point where it contacts the shoulder 13. Also, in this way, a predetermined small distance a corresponding to the thickness of the shoulder 23 is ensured when the poles are opposite to and attract each other. This also enables a better opening a closing behavior to be gained.

The invention claimed is:

1. A magnetic holding device for holding together and releasing two elements movable relative to each other, said holding device comprising:

two holders attached to the elements in one-to-one correspondence, each holder having a recess;

at least one magnet received in the recess and having a cross sectional shape matching a cross sectional shape of the recess, with the shape of both the magnet and the recess being asymmetric so as to allow insertion of the magnet in the recess in only one disposition; and an actuating device mounted to one of the holders to move the holder between a first position in which the magnet of one holder and the magnet of the other holder attract one another, and a second position in which the magnet of the one holder and the magnet of the other holder repel one another to maintain a distance between the holders.

2. The magnetic holding device of claim 1, wherein the magnet has opposite corners defined by different radii.

3. The magnetic holding device of claim 1, wherein the recess in the holder is formed so that the magnet is pressable with its front side to a stop.

4. The magnetic holding device of claim 1, wherein the recess in the holder is formed so that the magnet is pressable with its back side to a stop.

5. A magnetic holding device for holding together and releasing two elements movable relative to each other, said holding device comprising:

two holders attached to the elements in one-to-one correspondence, each holder having a recess;

at least one magnet received in the recess and having a cross sectional shape matching a cross sectional shape of the recess, with the shape of both the magnet and the recess being asymmetric in that the cross-sectional shape of both the magnet and the recess coincide only in one disposition when turned relative to each other about an axis perpendicular to a cross sectional plane so as to allow insertion of the magnet in the recess in only one disposition; and an actuating device mounted to one of the holders to move the holder between a first position in which the magnet of one holder and the magnet of the other holder attract one another, and a second position in which the magnet of the one holder and the magnet of the other holder repel one another to maintain a distance between the holders.

* * * * *